US010422157B1

(12) United States Patent
Lindstead

(10) Patent No.: US 10,422,157 B1
(45) Date of Patent: Sep. 24, 2019

(54) GRIP ENHANCING DOOR KNOB COVER

(71) Applicant: Rebecca Lindstead, Eugene, OR (US)

(72) Inventor: Rebecca Lindstead, Eugene, OR (US)

( * ) Notice: Subject to any disclaimer, the term of this patent is extended or adjusted under 35 U.S.C. 154(b) by 0 days.

(21) Appl. No.: 16/174,375

(22) Filed: Oct. 30, 2018

(51) Int. Cl.
*E05B 1/00* (2006.01)

(52) U.S. Cl.
CPC ..... *E05B 1/0053* (2013.01); *E05B 1/003* (2013.01); *E05B 1/0007* (2013.01); *E05B 1/0061* (2013.01)

(58) Field of Classification Search
CPC ..... E05B 1/0053; E05B 1/0007; E05B 1/003; E05B 1/0061; E05B 1/0015; Y10T 16/459; Y10T 16/46; Y10T 16/466; Y10T 16/487; Y10T 16/506
See application file for complete search history.

(56) References Cited

U.S. PATENT DOCUMENTS 1,590,629 A 6/1926 Julius
2,721,597 A 10/1955 Frank
2,753,911 A * 7/1956 Haslett ..... E05B 1/0061 150/155
2,997,089 A * 8/1961 Amdur ..... E05B 1/0061 118/505
3,072,955 A * 1/1963 Mitchell ..... A45F 5/10 16/411
3,306,643 A * 2/1967 Reed ..... E05B 13/001 16/402
D211,398 S * 6/1968 Hall ..... E05B 13/001 D8/310
4,082,351 A * 4/1978 Chrones ..... E05B 13/001 16/414
4,397,489 A * 8/1983 Lind ..... E05B 1/0053 16/413
4,504,087 A * 3/1985 Pennington ..... E05B 1/0053 16/413
5,008,551 A 4/1991 Randolph
D329,590 S * 9/1992 Chapman ..... E05B 1/0053 D8/322
5,495,641 A * 3/1996 Going ..... E05B 1/0053 16/414
5,615,567 A * 4/1997 Kemp ..... E05B 17/002 70/423
5,701,635 A * 12/1997 Hawkes ..... E05B 1/0061 16/421

(Continued)

FOREIGN PATENT DOCUMENTS

JP 11350804 A * 12/1999
KR 100858445 B1 * 9/2008
WO 1992001596 2/1992

*Primary Examiner* — Chuck Y Mah
(74) *Attorney, Agent, or Firm* — Kyle A. Fletcher, Esq.

(57) ABSTRACT

The grip enhancing door knob cover covers the knob of a door and may facilitate turning the door knob to open the door. A convex front cover section and convex rear cover section may be coupled to a cylindrical center cover section to form a shell that surrounds the door knob. A front aperture may provide access to the front of the door knob to insert a key or manually move a locking device on the knob. A rear aperture provides an opening for the shank of the door knob to pass through. The grip enhancing door knob cover may be composed of natural or synthetic rubber, silicone rubber, or other polymers. In some embodiment, the inside wall of the center cover section may comprise texturing to enhance the frictional grip of the shell against the knob.

15 Claims, 4 Drawing Sheets

(56) References Cited

U.S. PATENT DOCUMENTS

| | | | | | |
|---|---|---|---|---|---|
| 5,713,615 | A | | 2/1998 | Tsai | |
| 5,840,122 | A | * | 11/1998 | Williams | E05B 1/0061 118/505 |
| 5,933,915 | A | * | 8/1999 | El Dessouky | E05F 5/06 16/82 |
| D427,046 | S | | 6/2000 | Mannix | |
| 6,154,928 | A | * | 12/2000 | Thom | E05B 1/0053 16/413 |
| 6,834,414 | B2 | * | 12/2004 | Chiu | E05C 17/56 16/82 |
| 7,661,734 | B2 | * | 2/2010 | Lignell | E05B 13/001 292/288 |
| 8,353,085 | B2 | * | 1/2013 | Balzano | A47K 5/12 16/110.1 |
| 9,051,757 | B2 | * | 6/2015 | Bracey | E05B 1/0069 |
| 2006/0006678 | A1 | | 1/2006 | Herron | |

* cited by examiner

GRIP ENHANCING DOOR KNOB COVER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of door hardware, more specifically, a grip enhancing door knob cover.

SUMMARY OF INVENTION

The grip enhancing door knob cover covers the knob of a door and may facilitate turning the door knob to open the door. A convex front cover section and convex rear cover section may be coupled to a cylindrical center cover section to form a shell that surrounds the door knob. A front aperture may provide access to the front of the door knob to insert a key or manually move a locking device on the knob. A rear aperture provides an opening for the shank of the door knob to pass through. The grip enhancing door knob cover may be composed of natural or synthetic rubber, silicone rubber, or other polymers. In some embodiment, the inside wall of the center cover section may comprise texturing to enhance the frictional grip of the shell against the knob.

An object of the invention is to provide a grip-enhancing cover for a door knob to ease the task of turning the knob to open the door.

Another object of the invention is to provide front and rear apertures for key access and passing the door knob shank.

A further object of the invention is to provide a textured interior wall for at least a portion of the shell surrounding the knob.

Yet another object of the invention is to provide a reinforcing rim around the front and rear apertures for strength.

These together with additional objects, features and advantages of the grip enhancing door knob cover will be readily apparent to those of ordinary skill in the art upon reading the following detailed description of the presently preferred, but nonetheless illustrative, embodiments when taken in conjunction with the accompanying drawings.

In this respect, before explaining the current embodiments of the grip enhancing door knob cover in detail, it is to be understood that the grip enhancing door knob cover is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the grip enhancing door knob cover.

It is therefore important that the claims be regarded as including such equivalent construction insofar as they do not depart from the spirit and scope of the grip enhancing door knob cover. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
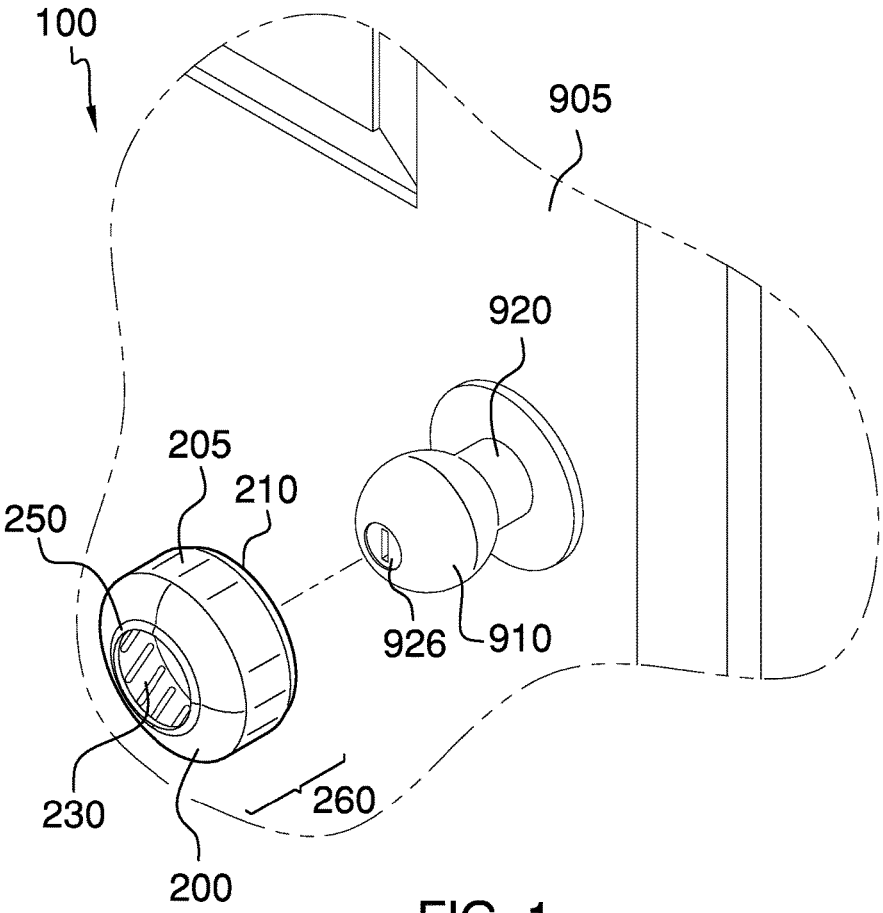
FIG. 1 is a perspective view of an embodiment of the disclosure.
Figure 2:
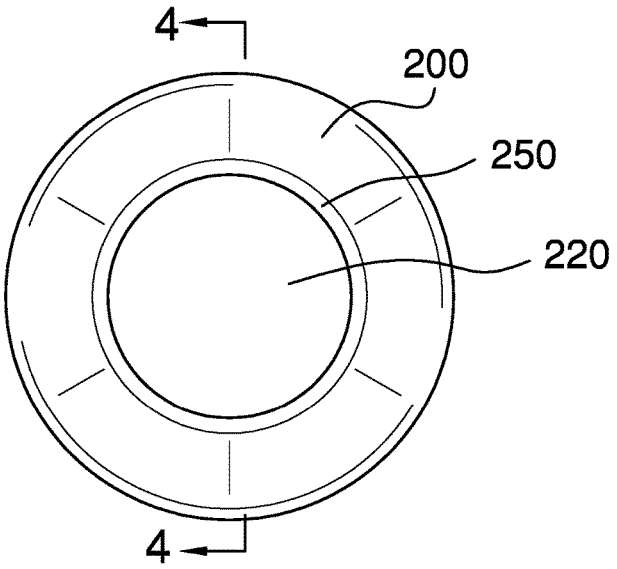
FIG. 2 is a front view of an embodiment of the disclosure.
Figure 3:
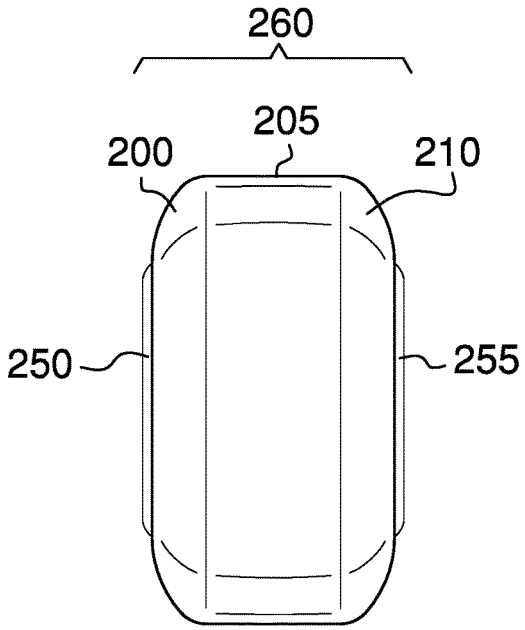
FIG. 3 is a top view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Detailed reference will now be made to a first potential embodiment of the disclosure, which is illustrated in FIGS. 1 through 5.

The grip enhancing door knob cover 100 (hereinafter invention) comprises a front cover section 200, a center cover section 205, a rear cover section 210, a front aperture 220, and a rear aperture 225. The invention 100 may cover a knob 910 of a door knob and may facilitate turning the knob 910 to open a door 905.

The front cover section 200 may comprise the front portion of the invention 100. The front cover section 200 may be circular when viewed from the front of the invention 100. The front cover section 200 may be vertically oriented and may be symmetrical around a centerline 915 of the invention 100. The front cover section 200 may be convex as seen from front of the invention 100. The front cover section 200 may be concave as seen from the center of the invention 100. The front cover section 200 may be a substantially uniform thickness. The rear of the front cover section 200 may couple to the center cover section 205.

The center cover section 205 may comprise the center portion of the invention 100. The center cover section 205 may be circular when viewed from the front of the invention 100. The center cover section 205 may be vertically oriented and may be symmetrical around the centerline 915 of the invention 100. The center cover section 205 may be cylindrical as seen from the front of the invention 100.

The rear cover section 210 may comprise the rear portion of the invention 100. The rear cover section 210 may be circular when viewed from the front of the invention 100. The rear cover section 210 may be vertically oriented and may be symmetrical around the centerline 915 of the invention 100. The rear cover section 210 may be convex as seen from rear of the invention 100. The rear cover section 210 may be concave as seen from the center of the invention 100. The rear cover section 210 may be a substantially uniform thickness. The front of the rear cover section 210 may couple to the center cover section 205.

The front aperture 220 may be an aperture in the front cover section 200. The center of the front aperture 220 may coincide with the centerline 915 of the invention 100

The rear aperture 225 may be an aperture in the rear cover section 210. The center of the rear aperture 225 may coincide with the centerline 915 of the invention 100

The front cover section 200, the center cover section 205, and the rear cover section 210 may be coupled to form a shell 260. The shell 260 may cover the knob 910 of the door knob when the invention 100 is installed on the knob 910. A shank 920 of the door knob may exit the shell 260 through the rear of the shell 260 via the rear aperture 225. The front aperture 220 may provide access to a pushbutton lock, a privacy snib, a keyhole 926, or other locking mechanism.

In some embodiments, the front cover section 200 may thicken adjacent to the front aperture 220 to form a front reinforcing rim 250. The front reinforcing rim 250 may resist tearing of the front cover section 200 during use.

In some embodiments, the rear cover section 210 may thicken adjacent to the rear aperture 225 to form a rear reinforcing rim 255. The rear reinforcing rim 255 may resist tearing of the rear cover section 210 during use.

The invention 100 may further comprise a textured wall 230 located on the interior of the center cover section 205. The textured wall 230 may increase friction between the knob 910 and the center cover section 205. The textured wall 230 may comprise protrusions from the interior wall of the center cover section 205 projecting towards the center of the invention 100.

Figure 4:
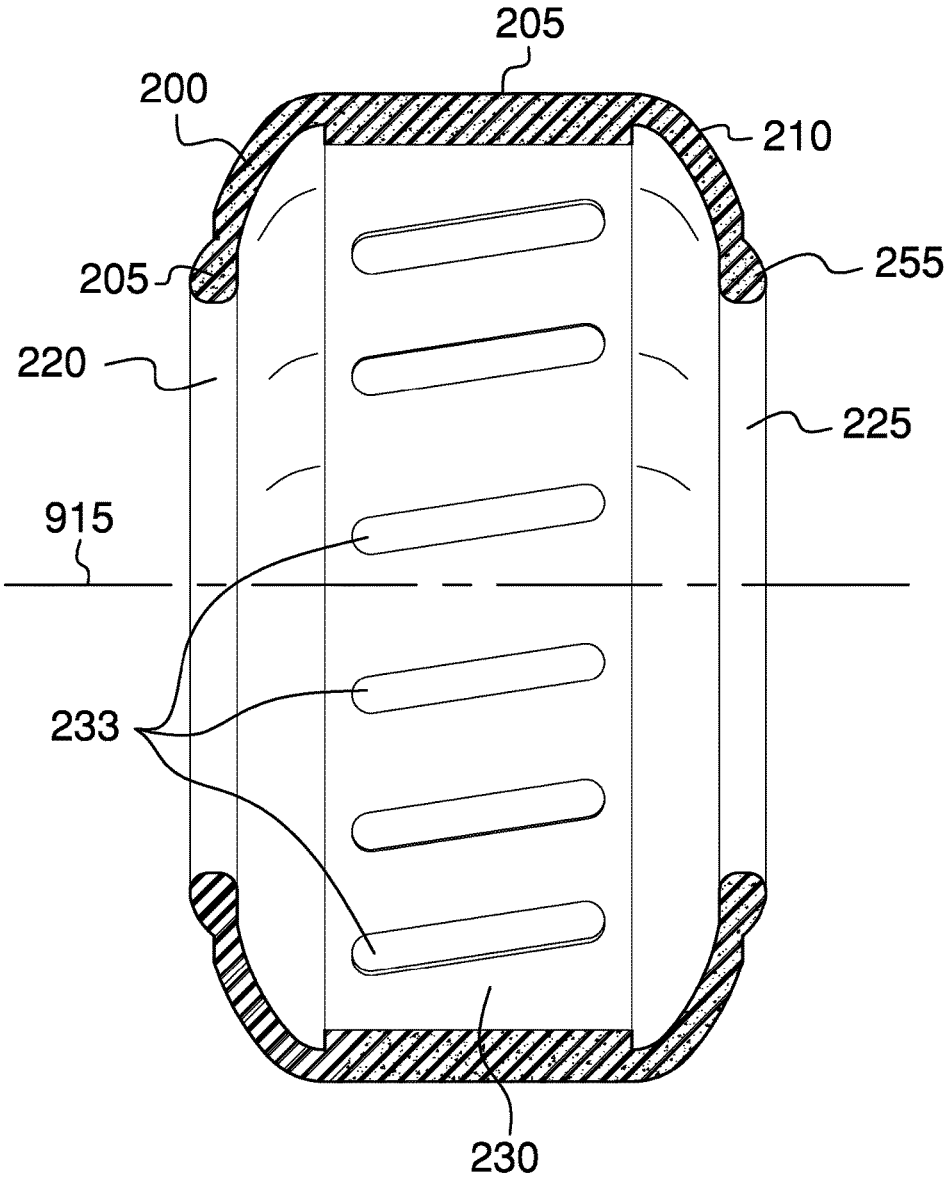
FIG. 4 is a cross-sectional view of an embodiment of the disclosure across 4-4 as shown in FIG. 2.

In some embodiments, the textured wall 230 may comprise a plurality of raised ribs projecting from the interior wall of the center cover section 205 as shown in FIG. 4. In some embodiments, the plurality of raised ribs may be canted at an oblique angle to the centerline 915.

Figure 5:
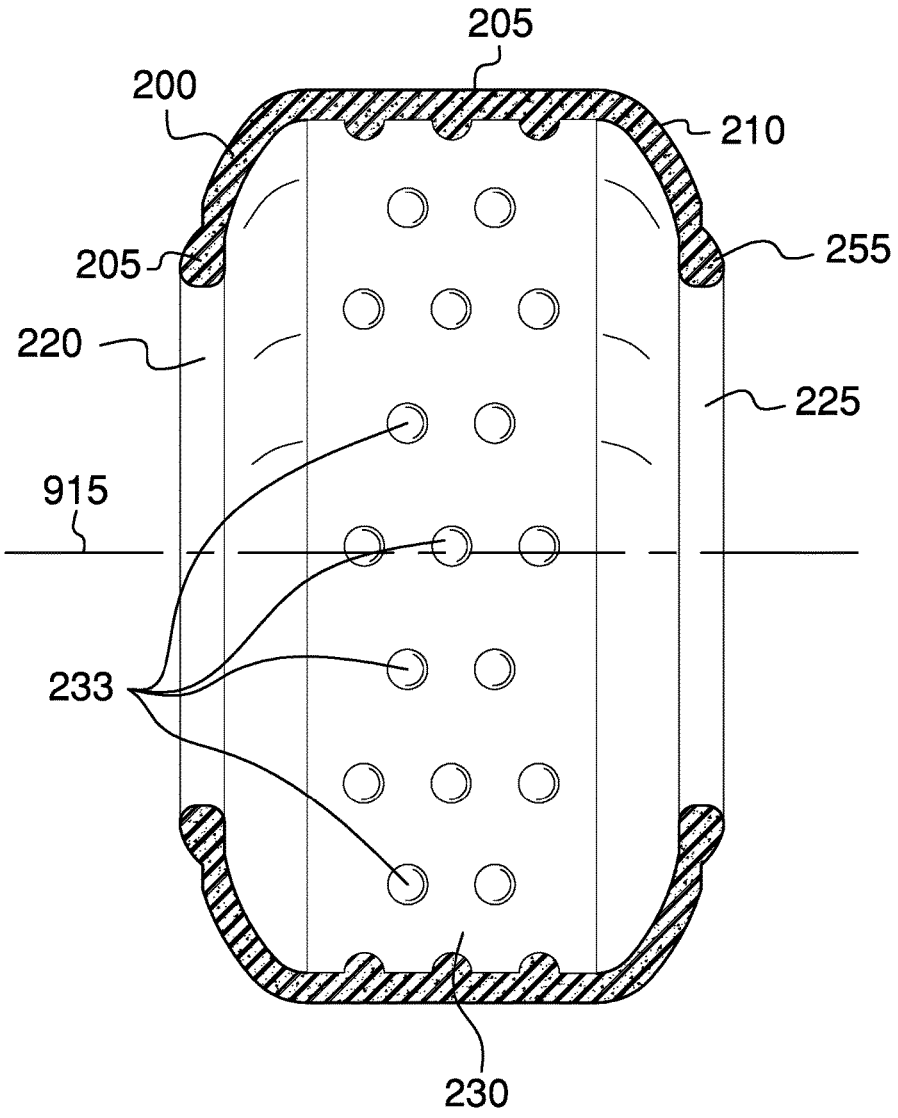
FIG. 5 is a cross-sectional view of an alternative embodiment of the disclosure across 4-4 as shown in FIG. 2.

In some embodiments, the textured wall 230 may comprise a plurality of raised bumps projecting from the interior wall of the center cover section 205 as shown in FIG. 5.

In some embodiments, the invention 100 may be composed of natural rubber, synthetic rubber, silicone rubber, other polymers, or combinations thereof.

In some embodiments, the front cover section 200, the center cover section 205, the rear cover section 210, the textured wall 230, or combinations thereof may be molded as a single part.

In some embodiments, the inside diameter of the center cover section 205 may be less than or equal to the outside diameter of the knob 910. The rear aperture 225 may be stretched open to install the invention 100 over the knob 910.

Definitions

As used in this disclosure, an "aperture" is an opening in a surface. Aperture may be synonymous with hole, slit, crack, gap, slot, or opening.

As used in this disclosure, a "cant" is an angular deviation from one or more reference planes such as a vertical plane or a horizontal plane.

As used in this disclosure, the "centerline" is an imaginary line that defines the center of multiple cross sections of an object. Unless stated otherwise, the centerline follows a longitudinal path through the object at the center of lateral cross sections. If the object is tubular, the centerline follows the center of the tube.

As used in this disclosure, "concave" is used to describe a surface that resembles the interior surface of a sphere or a portion thereof.

As used in this disclosure, "convex" is used to describe a surface that resembles the exterior surface of a sphere or a portion thereof.

As used herein, the words "couple", "couples", "coupled" or "coupling", refer to connecting, either directly or indirectly, and does not necessarily imply a mechanical connection.

As used in this disclosure, a "diameter" of an object is a straight line segment that passes through the center (or center axis) of an object. The line segment of the diameter is terminated at the perimeter or boundary of the object through which the line segment of the diameter runs.

As used in this disclosure, a "door" is a movable or removable barrier that is attached to the wall of a room or the surface of a container for the purpose of allowing or preventing access through an aperture into the room or container.

As used herein, "front" indicates the side of an object that is closest to a forward direction of travel under normal use of the object or the side or part of an object that normally presents itself to view or that is normally used first. "Rear" or "back' refers to the side that is opposite the front.

As used in this disclosure, a "grip" is a covering that is placed over a hand hold, handle, shaft, or other object.

As used herein, "inside diameter" or "inner diameter" refers to a measurement made on a hollow object. Specifically, the inside diameter is the distance from one inside wall to the opposite inside wall. If the object is round, then the inside diameter is a true diameter, however the term may also be used in connection with a square object in which case the inside diameter is simply the narrowest inside measurement that passes through the center of the object.

As used in this disclosure, the word "interior" is used as a relational term that implies that an object is located or contained within the boundary of a structure or a space.

As used in this disclosure, a "lock" is a fastening device that is released through the use of a key, a numeric or alphanumeric combination, or a biometric identification protocol.

As used herein, "oblique angle" refers to any angle that is not a right angle or a multiple of a right angle.

As used herein, "outside diameter" or "outer diameter" refers to a measurement made on an object. Specifically, the outside diameter is the distance from one point on the outside of the object to a point on the opposite side of the object along a line passing through the center of the object. The term outside diameter is frequently used in conjunction with round objects such as hollow conduits in which case the outside diameter is a true diameter, however the term may also be used in connection with a square object in which case the outside diameter is simply the widest outside measurement that passes through the center of the conduit.

As used in this disclosure, a "rim" is an outer edge or border that follows along the perimeter of an object.

As used in this disclosure, a "shell" is a structure that forms an outer covering intended to contain an object. Shells are often, but not necessarily always, rigid or semi-rigid structures that are intended to protect the object contained within it. Some shells may only partially cover the exterior surface of the object.

As used herein, "snib" refers to a manually operated catch for the internal restraint of a lock. A snib may determine whether a door lock engages or not once the door is closed. A snib located on the end of a door knob to control the locking and unlocking of the door knob may be referred to as a privacy snib.

As used herein, the word "substantially" indicates that two or more attributes are the same except for a margin of error related to variances in materials, manufacturing processes, craftsmanship, installation, environmental conditions, or other factors that may influence the attributes and that the differences introduced by these factors are not considered detrimental to the operation of the invention as described herein.

As used in this disclosure, "vertical" refers to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A grip enhancing door knob cover comprising:

a front cover section, a center cover section, a rear cover section, a front aperture, and a rear aperture;

wherein the grip enhancing door knob cover covers a knob of a door knob and facilitates turning the knob to open a door;

wherein the front cover section comprises the front portion of the grip enhancing door knob cover;

wherein the front cover section is circular when viewed from the front of the grip enhancing door knob cover;

wherein the front cover section is vertically oriented and is symmetrical around a centerline of the grip enhancing door knob cover;

wherein the front cover section is convex as seen from front of the grip enhancing door knob cover;

wherein the front cover section is concave as seen from the center of the grip enhancing door knob cover;

wherein the front cover section is a substantially uniform thickness;

wherein the rear of the front cover section couples to the center cover section;

wherein the center cover section comprises the center portion of the grip enhancing door knob cover;

wherein the center cover section is circular when viewed from the front of the grip enhancing door knob cover;

wherein the center cover section is vertically oriented and is symmetrical around the centerline of the grip enhancing door knob cover;

wherein the center cover section is cylindrical as seen from the front of the grip enhancing door knob cover;

wherein the rear cover section thickens adjacent to the rear aperture to form a rear reinforcing rim;

wherein the rear reinforcing rim resists tearing of the rear cover section during use;

wherein the grip enhancing door knob cover further comprises a textured wall located on an interior of the center cover section;

wherein the textured wall increases friction between the knob and the center cover section.

2. The grip enhancing door knob cover according to claim 1 wherein the rear cover section comprises the rear portion of the grip enhancing door knob cover;

wherein the rear cover section is circular when viewed from the front of the grip enhancing door knob cover;

wherein the rear cover section is vertically oriented and is symmetrical around the centerline of the grip enhancing door knob cover;

wherein the rear cover section is convex as seen from rear of the grip enhancing door knob cover;

wherein the rear cover section is concave as seen from the center of the grip enhancing door knob cover;

wherein the rear cover section is a substantially uniform thickness;

wherein the front of the rear cover section couples to the center cover section.

3. The grip enhancing door knob cover according to claim 2 wherein the front aperture is an aperture in the front cover section;

wherein the center of the front aperture coincides with the centerline of the grip enhancing door knob cover.

4. The grip enhancing door knob cover according to claim 3 wherein the rear aperture is an aperture in the rear cover section;

wherein the center of the rear aperture coincides with the centerline of the grip enhancing door knob cover.

5. The grip enhancing door knob cover according to claim 4 wherein the front cover section, the center cover section, and the rear cover section are coupled to form a shell;

wherein the shell covers the knob of the door knob when the grip enhancing door knob cover is installed on the knob.

6. The grip enhancing door knob cover according to claim 5 wherein a shank of the door knob exits the shell through the rear of the shell via the rear aperture.

7. The grip enhancing door knob cover according to claim 6 wherein the front aperture provides access to a pushbutton lock, a privacy snib, a keyhole, or other locking mechanism.

8. The grip enhancing door knob cover according to claim 7 wherein the front cover section thickens adjacent to the front aperture to form a front reinforcing rim;

wherein the front reinforcing rim resists tearing of the front cover section during use.

9. The grip enhancing door knob cover according to claim 8 wherein the textured wall comprises protrusions from the interior wall of the center cover section projecting towards the center of the grip enhancing door knob cover.

10. The grip enhancing door knob cover according to claim 9 wherein the textured wall comprises a plurality of raised ribs projecting from the interior wall of the center cover section.

11. The grip enhancing door knob cover according to claim 10 wherein the plurality of raised ribs are canted at an oblique angle to the centerline.

12. The grip enhancing door knob cover according to claim 9 wherein the textured wall comprises a plurality of raised bumps projecting from the interior wall of the center cover section.

13. The grip enhancing door knob cover according to claim 8 wherein the grip enhancing door knob cover is composed of natural rubber, synthetic rubber, silicone rubber, other polymers, or combinations thereof.

14. The grip enhancing door knob cover according to claim 8 wherein the front cover section, the center cover section, the rear cover section, the textured wall, or combinations thereof are molded as a single part.

15. The grip enhancing door knob cover according to claim 14 wherein the inside diameter of the center cover section is less than or equal to the outside diameter of the knob;

wherein the rear aperture is stretched open to install the grip enhancing door knob cover over the knob.

* * * * *